US005489053A

United States Patent [19]

Davis

[11] Patent Number: 5,489,053

[45] Date of Patent: Feb. 6, 1996

[54] GUN SECUREMENT ASSEMBLY AND METHOD TO USE THE SAME

[75] Inventor: Richard C. Davis, Traverse City, Mich.

[73] Assignee: Second Chance Body Armor, Inc., Central Lake, Mich.

[21] Appl. No.: 163,858

[22] Filed: Dec. 7, 1993

[51] Int. Cl.[6] ..... F41C 33/00

[52] U.S. Cl. ..... 224/243; 224/249; 224/901; 224/911; 224/250

[58] Field of Search ..... 224/192, 193, 224/235–238, 240–245, 249, 250, 253, 901, 911, 912

[56] References Cited

U.S. PATENT DOCUMENTS

| | | | |
|---|---|---|---|
| 2,970,727 | 2/1961 | Bohlin | 224/253 X |
| 4,312,466 | 1/1982 | Clark | 224/243 |
| 4,580,707 | 4/1986 | Shoemaker | 224/193 X |
| 4,815,641 | 3/1989 | Bianchi et al. | 224/238 |
| 5,094,376 | 3/1992 | Baruch | 224/243 |
| 5,163,591 | 11/1992 | Leiserson et al. | 224/250 X |
| 5,246,153 | 9/1993 | Beletsky | 224/192 |
| 5,294,031 | 3/1994 | Volpei et al. | 224/192 X |

*Primary Examiner*—J. Casimer Jacyna
*Attorney, Agent, or Firm*—Potthast & Ring

[57] ABSTRACT

A gun securement assembly (10) for holster (12) in which holster (12) has sidewall member (14) in form of a receptacle to hold gun (16) and defines opening (18) at which butt and hammer portion (20) of gun (16) is positioned for access having strap member (24) and another strap member (26) for disposing over said opening (18) of holster (12) for positioning hammer portion (20) between at least a portion of strap member (24) and at least a portion of another strap member (26) and securing the strap member (24) and another strap member (26) to sidewall (14) of holster (12). Gun securement assembly (10) also includes having tab member (42) for positioning over opening and releasably securing and variably positioning (52) tab member (42) to sidewall (14) at various positions along and adjacent to periphery of opening (18). A method for securing gun (16) within holster (12) which includes disposing strap member (24) and another strap member (26) over opening (18) for positioning hammer portion (20) between at least a portion of strap member (24) and at least a portion of another strap member (26) and securing strap member (24) and another strap member (26) to sidewall (14) . Another method for securing gun (16) within holster (12) is provided having the steps of releasably securing and variably positioning (52) tab member (42) to sidewall (14) along the periphery of opening (18), and positioning tab member (42) over opening (18) of holster (12).

18 Claims, 4 Drawing Sheets

GUN SECUREMENT ASSEMBLY AND METHOD TO USE THE SAME

BACKGROUND OF THE INVENTION

1. Field of the Invention

The present invention relates to a gun securement assembly for a holster and method to use the same, and more particularly, a strap assembly for disposing over an opening to the holster where the butt and hammer portion of a gun held in the holster are positioned for access and a method to use the same.

2. Description of the related art including information disclosed under 37 CFR 1.97–1.99

Various holster assemblies for securing guns within a holster are known. These assemblies have straps that are secured to the holster and position themselves over the opening in the holster thereby restraining the gun held within the holster as seen in U.S. Pat. Nos. 4,815,641 issued on Mar. 28, 1989, to Bianchi et al.; 5,094,376 issued on Mar. 10, 1992, to Baruch; 4,886,197 issued on Dec. 12, 1989, to Bowles et al.; 4,750,655 issued Jun. 14, 1988, to Barry; 4,312,466 issued on Jan. 26, 1982; and 4,270,680 issued Jun. 2, 1981, to Bianchi. However, none of these assemblies have strap members that will position a hammer portion of a gun between themselves and thereby provide such engaging securement.

Further, none of the straps of these assemblies can releasably secure and variably position a strap to a sidewall of the holster at various positions along and adjacent to the periphery of the opening of the holster where the butt and hammer portion of a gun held in the holster are positioned for access. Thus, the straps are not mounted with versatility to accommodate a choice of various desired positions of a strap along the opening of the holster by the wearer.

SUMMARY OF THE INVENTION

It is therefore the principal object of the present invention to provide a gun securement assembly for a holster in which the holster has a sidewall member in a configuration to define a receptacle to hold a gun and defines an opening at which a butt and hammer portion of the gun is accessible having a strap member and another strap member for disposing over said opening of said holster for positioning said hammer portion between at least a portion of said strap member and at least a portion of said another strap member and securing the strap member and another strap member to the sidewall of the holster.

Another object of the invention is to provide a gun securement assembly for a holster in which the holster has a sidewall member in a configuration to define a receptacle to hold a gun and defines an opening at which a butt and hammer portion of the gun is accessible, having a tab member for positioning over said opening of said holster and releasably securing and variably positioning said tab member to the sidewall of said holster at various positions along and adjacent to the periphery of said opening of said holster.

A further object of this invention is to provide a method for securing a gun within a holster in which the holster has a sidewall member in a configuration to define a receptacle to hold a gun and defines an opening in which a butt and hammer portion of the gun is accessible at said opening having the steps of disposing a strap member and another strap member over said opening of said holster for positioning said hammer portion between at least a portion of said strap member and at least a portion of said another strap member and securing the strap and another strap member to the sidewall of the holster.

Another object of this invention is to provide a method for securing a gun within a holster in which the holster has a sidewall member in a configuration to define a receptacle to hold a gun and defines an opening at which a butt and hammer portion of the gun is accessible having the steps of releasably securing and variably positioning a tab member to said sidewall along the periphery of said opening of said holster, and positioning said tab member over said opening of said holster.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENTS

Figure 1:
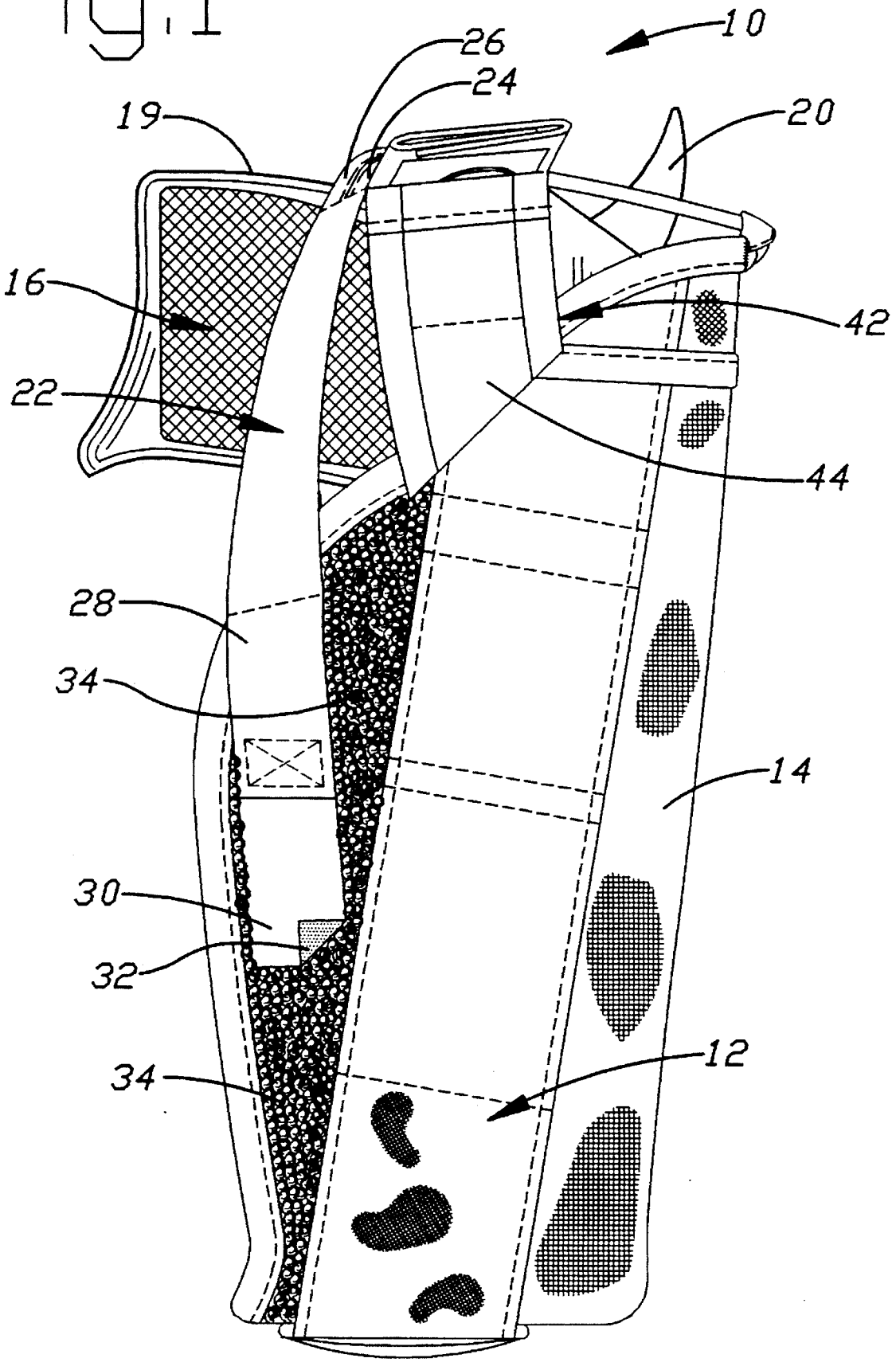
FIG. 1 is a side elevational view of the gun securement assembly.
Figure 2:
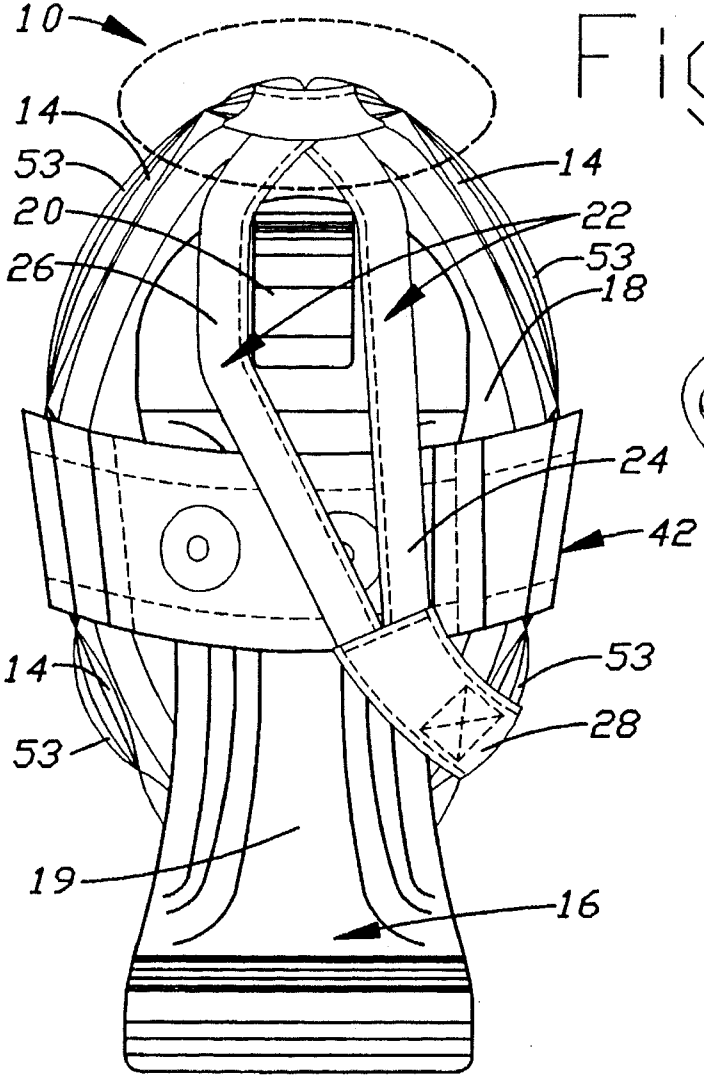
FIG. 2 is a top plan view of the gun securement assembly.

Referring now to the drawings, gun securement assembly 10 for holster 12 seen in FIGS. 1 and 2, in which holster 12 has sidewall member 14 in a configuration to define a receptacle to hold gun 16 and defines opening 18 at which butt and hammer portion 19, 20 of gun 16 is positioned for access. Holster 12 is flexible and is composed of ballistic resistant material such as a multilayer ballistic nylon such as Kevlar®, so that it is lightweight, formfitting, and weather resistant, as well as ballistic resistant. Because safety of the wearer is important, particularly in police environments, holster 12 is designed to reduce or prevent gun 16 from being removed from holster 12 by a second person or accidentally during strenuous activity.

Although gun 16 will rest in holster 12 and be supported reasonably well, the preference has been and is to restrain gun 16 from being lifted out of holster 12, or dropping out of holster 12. Such restraint is therefore, as illustrated in FIGS. 1–3, provided by a selectable gun securement assembly 10.

Referring to FIG. 1, this gun securement assembly 10 includes strap assembly 22 and thumb release 42. Thumb release member 42 retrains gun 16 from being lifted out of holster 12 accidentally or without the wearer's authorization. Strap assembly 22 when secure, is an added measure of securement to help alleviate gun 16 from being lifted out of holster 12 when secured in unison with thumb release member 42. Strap assembly 22 and thumb release member 42 are discussed in more detail below.

Figure 3:
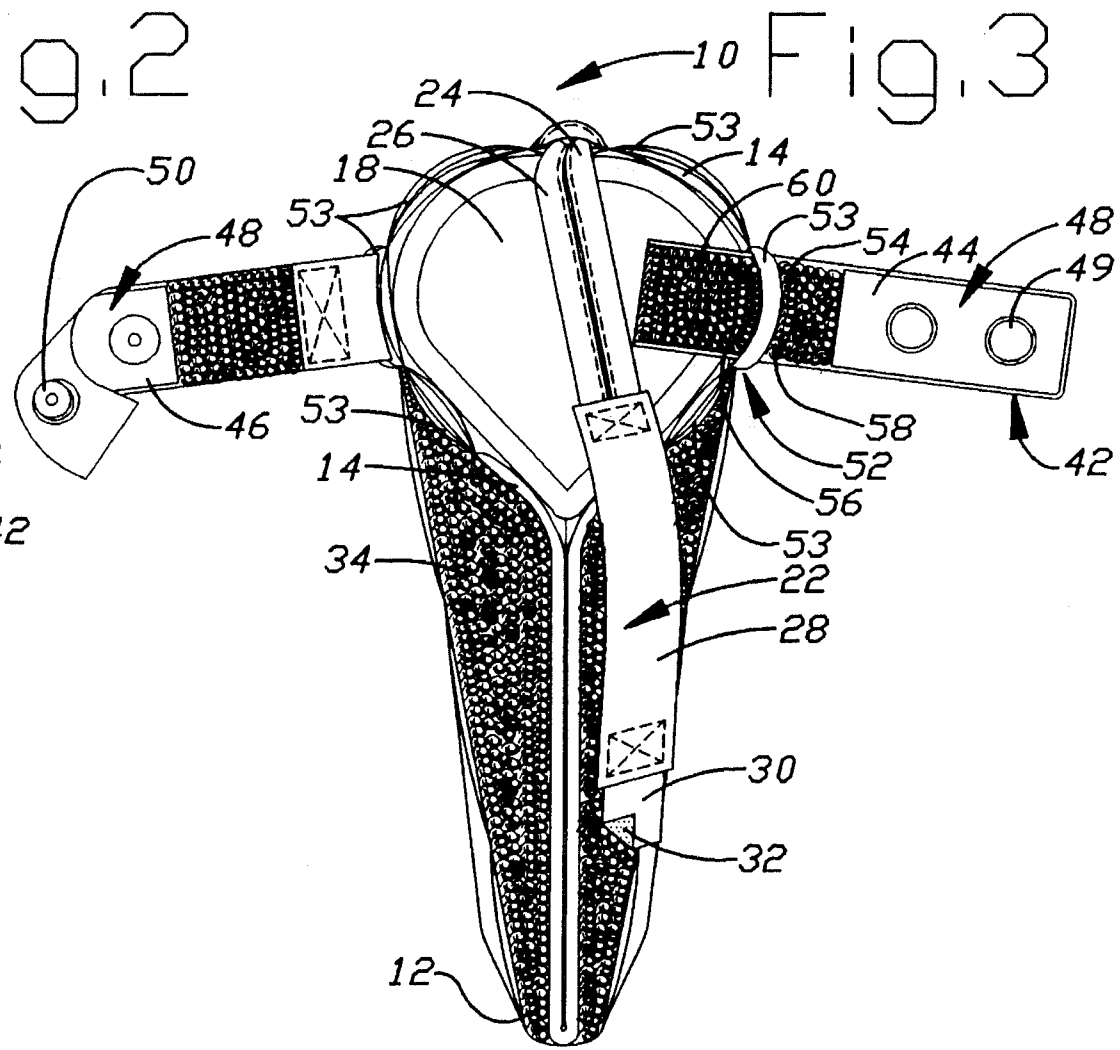
FIG. 3 is a perspective view of the gun securement assembly partially unsecured and without a gun.

Referring to FIGS. 1–3, strap assembly 22 includes strap member 24 and another strap member 26 disposed over opening 18 of holster 12 to position hammer portion 20 between at least a portion of strap member 24 and at least a portion of another strap member 26. Strap member 24 and another strap member 26 are flexible so that hammer portion 20 is positioned between a portion of strap member 24 and at least a portion of another strap member 26 so that hammer portion 20 of gun 16 is more secure from unwanted removal from holster 12. Hammer portion 20 being positioned between strap member 24 and another strap member 26 help alleviate gun 16 from sliding under strap member 24 or another strap member 26 so that gun 16 cannot be removed from holster 12 without authorization from wearer.

Still referring to FIGS. 1 and 3, strap member 24 and another strap member 26 are secured to sidewall 14 and to single strap element 28. Single strap element 28 has an end 30 releasably secured to sidewall 14. End 30 of single strap element 28 is releasably secured to sidewall 14 by a pair of clusters of mating hook and loop fasteners, such as Velcro®, in which one of the pair of clusters 32 is attached to end 30 of single strap element 28 and the other of the pair of clusters 34 is attached to an outer portion of sidewall 14. One pair of clusters 34 attached to outer portion of sidewall 14 extends away from opening 18 of holster 12. This is done in order that end 30 can be releasably secured to sidewall 14 at desired locations higher or lower on holster 12 thereby, providing a tighter or looser securement of gun 16, as discussed in more detail below.

It is desirable to have sidewall 14 covered with clusters 34 in an expanded area in order to facilitate ease and quickness in securing end 30 from sidewall 14 as well as providing ease and quickness, based on the location of end 30, to gain access to gun 16o Various positions on sidewall 14 may preferably accommodate the wearer depending on whether the wearer is left or right handed.

clusters 34 are attached to expanded areas on sidewall 14 to facilitate, as mentioned above, adjusting how tight or lose strap assembly 22 is secured over gun 16. The adjustability is further enhanced by single strap element 28 having at least a portion constructed of a resilient material which therefore enables strap assembly 22 to be extended to have end 30 reach cluster 34 further from opening 18 thereby providing a tighter securement. This adjustment is also needed to accommodate varying sized guns. Therefore, the combination of the resiliency of single strap element 28 and pair of clusters 34 extending over outer portion of sidewall 14 away from opening 18 enables both a large gun and a small gun to be releasably secured within opening 18 of holster 12 as well as providing the desired restraining force of securement over gun 16.

An advantage of using hook and loop fasteners 32, 34 such as Velcro®for clusters 32 and 34 in releasably securing end 30 to an outer portion of sidewall 14 is that these clusters of hook and loop fasteners 32, 34 make substantial noise when they are being released. This noisy release notifies the wearer when someone is releasing the wearer's weapon, whether intentionally or unintentionally, without his authorization, such as in crowds or when he or she is being bumped. Thus, the noise emitted by this securement when it is being unsecured alerts the wearer of the conditions in order for the wearer to take precautionary measures. Further, this securement provides much resistance if a pulling force is exerted on strap assembly 22 away from opening 18. Thus, this invention provides a releasable flexible securing means 32 that provides a tight securement with holster 12 and, when released, provides enough noise to notify the wearer that securing means 32 is being released. Therefore, the wearer is less likely to have someone withdraw his or her gun 16 without the wearer's knowledge that gun 16 is in the process of being released from holster 12.

Figure 4:
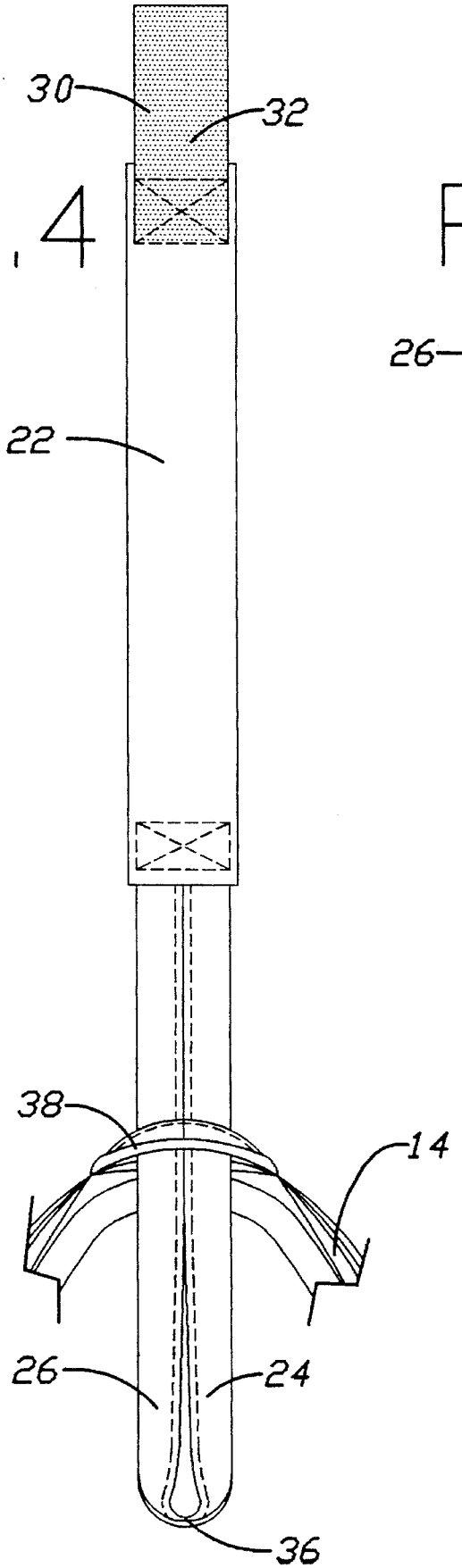
FIG. 4 is an enlarged view of the securement shown within the dotted area of FIG. 2 partially disassembled without the presence of a gun and in which the entire strap member is shown.
Figure 5:
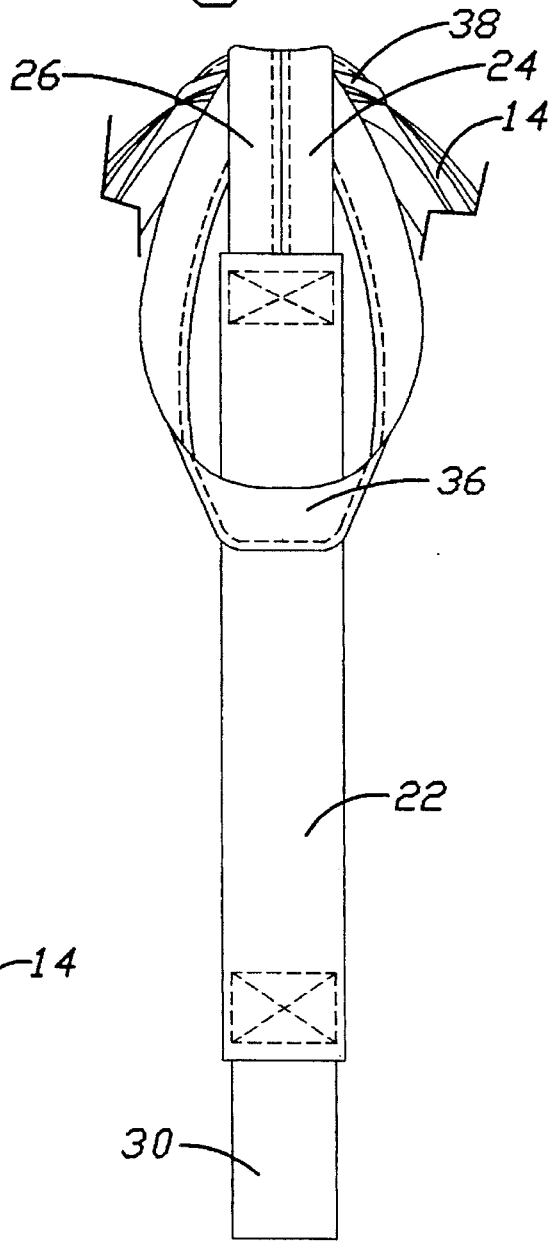
FIG. 5 is an enlarged view of the securement shown within the dotted area of FIG. 2 fully assembled without the presence of a gun and in which the entire strap member is shown.
Figure 6:
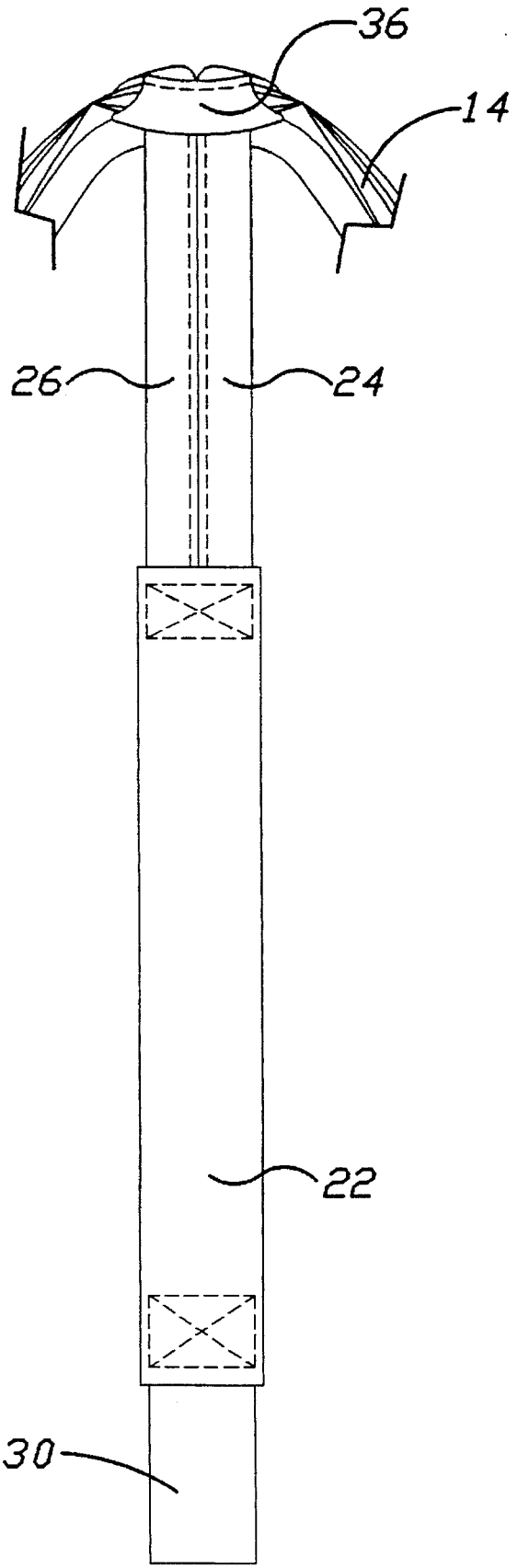
FIG. 6 is an enlarged view of the securement shown within the dotted area of FIG. 2 without the presence of a gun and in which the entire strap member is shown.

Referring to FIGS. 4–6, strap member 24 and another strap member 26 are secured to one another, which can include them being integrally formed, to form loop portion 36.

Still referring to FIGS. 4, 5 and 6, strap member 24 and strap member 26 are releasably secured to sidewall 14 of holster 12. One common way of releasably securing is to extend loop portion 36 through another loop portion 38 which is secured to sidewall 14, as seen in FIG. 4. In turn, as seen in FIG. 5, strap element 28 is extended through loop portion 36 to secure strap assembly 22 to another loop portion 38. Since strap assembly 22 is releasably secured, strap assembly 22 can easily be removed when the person wearing holster 12 decides he or she does not need the added protection of this additional security strap. Further, this type of securement will cause loop 36 to tighten to itself to loop 38 should an unwanted pulling force be exerted on strap assembly 22.

Referring to FIGS. 2 and 3, gun securement assembly 10 of a holster 12 includes thumb release member 42 secured to sidewall 14 and disposed over opening 18 of holster 12. Thumb release member 42 includes two tab members 44, 46 in which each tab member 44, 46 is secured to sidewall 14 of holster 12 to position each tab member 44, 46 at opposing sides of opening 18 of holster 12.

Gun securement assembly 10 includes means for releasably securing 52 at least one tab member 44 to sidewall 14 of holster 12 in which one tab member 44 is secured to sidewall 14 by a first loop member 53 secured to sidewall 14 adjacent opening 18 of holster 12, in which a portion of at least one tab member 44 extends through first loop member 53 and releasably secures itself to first loop member 53 with a pair of clusters of mating hook and loop fasteners 54, 56 in which one of said pair 54 is attached to said another portion 58 of at least one tab member 44 and the other of said pair 56 is attached to portion 60 of at least one tab member 44 to releasably engage to one another to secure about first loop member 53.

Still referring to FIG. 3, one of said pair of clusters of mating hook and loop fasteners 56 extends along another portion 58 away from said portion 60. Thus, at least one tab member 44 can be adjusted in length in order to accommodate a larger or a smaller gun within opening 18 of holster 12 by how far portion 60 is projected through loop 53 and folded over to secure to another portion 58.

Still referring to FIG. 3, gun securement assembly 10 includes means for releasably securing 48 tab members 44, 46 to each other 44, 46 at a position over opening 18 of holster 12. Such means 48 includes at least one pair of mating snap members 49, 50, at least one each secured to each of the two tab members 44, 46, respectively. However other common releasably securing means such as hook and loop fasteners such as Velcro®, or other similar means known in the art, could be used.

Referring to FIG. 3, gun securement assembly 10 of holster 12 includes tab member 42 positioned over opening 18 of holster 12 and means for releasably securing and variably positioning 52 tab member 42 to sidewall 14 of holster 12 at various positions along and adjacent to the periphery of opening 18 of holster 12. Tab member 42 includes at least two tab members 44, 46 positioned at opposing sides of opening 18 of holster 12 to each other. Gun securement assembly 10 of holster 12 includes means for releasably securing 48 at least two tab members 44, 46 to each other which includes a pair of mating snap members 49, 50 in which one of said pair 49, 50 is secured to each of said tab members 44, 46, respectively as earlier described.

Gun securement assembly 10 includes releasable securing and variable positioning means 52 having loops 53 secured to sidewall 14. Loops 53 are each secured in different positions on sidewall 14 along the periphery of opening 18 of holster 12. As is shown, it is preferable to have at least two loops 53 located on each of the opposing sides of opening 18. Means 52 further includes having a portion of tab member 42 extend through loops 53 and releasably secure itself to the described loop 53 with a pair of clusters of mating hook and loop fasteners 54, 56 in which one of said pair 54 is attaching to another portion 58 of tab member 42 and the other pair 56 is attached to portion 60 of tab member 42 to releasably engage to one another to secure about the desired first loop member 53. Thus, tab members 44, 46 can easily be secured to any desired loop 53 and releasably engaged to such loop 53 thereby giving the wearer versatility in positioning tab members 44, 46 about opening 18.

Further, as discussed previously, one of a pair of clusters of mating hook and loop fasteners 54 extend along another portion 58 away from portion 60, thereby providing the wearer variable positions to secure tab members 44, 46 to themselves and thereby adjust the length of tab members 44, 36 in order to accommodate a larger or a smaller gun within opening 18 of holster 12.

Referring to FIGS. 1, 2 and 3, a new method for securing gun 16 within holster 12 in which holster 12 has sidewall member 14 in a configuration to define a receptacle to hold gun 16 and defines opening 18 in which butt and hammer portion 20 of gun 16 is positioned at said opening 18 includes the steps of disposing strap member 24 and another strap member 26 over opening 18 of holster 12 to position said hammer portion 20 between at least a portion of strap member 24 and at least a portion of another strap member 26 and securing strap member 24 and another strap member 26 to sidewall 14 of holster 12.

Referring to FIG. 3, a new method for securing gun 16 within holster 12 is provided in which holster 12 has sidewall member 14 in a configuration to define a receptacle to hold gun 16 and defines opening 18 in which butt and hammer portion 20 of gun 16 is positioned at opening 18 includes the steps of releasably securing and variably positioning 52 tab member 42 to sidewall 14 by releasably securing tab member 42 to a desired loop 53 along the periphery of opening 18 of holster 12 and positioning tab member 42 over opening 18 of holster 12.

While a detailed description of the preferred embodiment of the invention has been given, it should be appreciated that many variations can be made thereto without departing from the scope of the invention set forth in the appended claims.

I claim:

1. A gun securement assembly for a holster in which the holster has a sidewall member in a configuration to define a receptacle to hold a gun and defines an opening at which a butt and hammer portion of the gun is accessible, comprising:

a strap member and another strap member, each having one end and another end, in which the strap member and another strap member are disposed over said opening of said holster for positioning said hammer portion between at least a portion of said strap member and at least a portion of said another strap member; and means for securing the strap member and another strap member to the sidewall of the holster which includes a single strap member having a first end secured to the one end of each the strap member and another strap member and in which a second end of the single strap member is releasably secured to the sidewall member, and in which the another ends of the strap member and another strap member are secured to one another to form a loop which extends through another loop secured to the sidewall member of the holster and in which the single strap member is extended through said loop securing another ends of strap member and another strap member to said another loop.

2. The gun securement assembly of a holster of claim 1 in which said strap member and another strap member are flexible.

3. The gun securement assembly of a holster of claim 1 in which at least a portion of said single strap element is constructed of resilient material.

4. The gun securement assembly of a holster of claim 1 in which said end of the strap element is releasably secured to said sidewall by a pair of clusters of mating hook and loop fasteners in which one of said pair is attached to said end and the other of said pair is attached to an outer portion of said sidewall.

5. The gun securement assembly of a holster of claim 4 in which one of said pair of clusters attached to said outer portion of said sidewall extends away from the opening of said holster.

6. The gun securement assembly of a holster of claim 1 in which said sidewall is composed of ballistic resistant material.

7. The gun securement assembly of a holster of claim 1 in which said sidewall is flexible.

8. The gun securement assembly of a holster of claim 1 includes a thumb release member secured to said sidewall and disposed over said opening of said holster.

9. The gun securement assembly of a holster of claim 8 in which the thumb release member includes two tab members in which each tab member is secured to said sidewall of said holster to position each tab member at opposing sides of the opening of said holster.

10. The gun securement assembly of a holster of claim 9 includes the means for releasably securing each tab member to said sidewall of said holster.

11. The gun securement assembly of a holster of claim 9 including a means for releasably securing the two tab members to each other at a position over said opening of said holster.

12. The gun securement assembly of a holster of claim 11 in which the releasable securing means includes a pair of mating snap members one each secured to each of the two tab members.

13. The gun securement assembly of a holster of claim 9 in which at least one tab member is secured to said sidewall of said holster by a first loop member secured to said sidewall, in which a portion of said at least one tab member extends through said first loop member and releasably secures itself to said first loop member with a pair of clusters of mating hook and loop fasteners in which one of said pair is attached to said portion of the at least one tab member and the other of said pair is attached to another portion of said at least one tab member to releasably engage to one another to secure about said first loop member.

14. The gun securement assembly of a holster of claim 13 in which said one of said pair of clusters of mating hook and loop fasteners extends along another portion away from said portion.

15. The gun securement assembly of a holster of claim 13 in which the first loop member is secured to said sidewall adjacent to said opening of said holster.

16. The gun securement assembly of a holster of claim 15 includes at least two first loop members each secured in a different position on said sidewall along the periphery of said opening.

17. A method for securing a gun within a holster in which the holster has a sidewall member in a configuration to define a receptacle to hold a gun and defines an opening in which a butt and hammer portion of the gun is accessible, comprising the steps of:

disposing a strap member and another strap member, each having one end and another end, over said opening of said holster for positioning said hammer portion between at least a portion of said strap member and at least a portion of said another strap member; and securing the strap member and another strap member to the sidewall of the holster which includes a single strap member having a first end secured to the one end of each the strap member and another strap member and in which a second end of the single strap member is releasably secured to the sidewall member, and in which the another ends of the strap member and another strap member are secured to one another to form a loop which extends through another loop secured to the sidewall member of the holster and in which the single strap member is extended through said loop securing another ends of strap member and another strap member to said another loop.

18. The method of securing a gun in a holster of claim 17 in which the steps of securing includes releasably securing the strap member and another strap member to the sidewall of the holster.

* * * * *